US005671872A

United States Patent [19]

Daniels, Jr.

[11] Patent Number: 5,671,872

[45] Date of Patent: Sep. 30, 1997

[54] LIQUID CONTAINER PAPER TOWEL HOLDER

[76] Inventor: Lovick T. Daniels, Jr., 223 Brighton Way, Casselberry, Fla. 32707

[21] Appl. No.: 638,110

[22] Filed: Apr. 26, 1996

[51] Int. Cl.[6] ..... B67D 5/42

[52] U.S. Cl. ..... 222/192; 222/383.1

[58] Field of Search ..... 239/289; 222/192, 222/321.7, 321.9, 383.1, 385

[56] References Cited

U.S. PATENT DOCUMENTS

| | | | |
|---|---|---|---|
| 1,255,772 | 2/1918 | Miller . | |
| 1,523,297 | 1/1925 | Savery . | |
| 1,582,645 | 4/1926 | Findley . | |
| 2,331,675 | 10/1943 | Frost . | |
| 2,742,191 | 4/1956 | Corsaw | 222/192 X |
| 2,746,798 | 5/1956 | Wardell, Jr. | 239/289 X |
| 3,881,628 | 5/1975 | Brainerd et al. . | |
| 4,436,224 | 3/1984 | McInerny | 222/192 X |
| 4,516,676 | 5/1985 | Cournoyer . | |
| 5,228,602 | 7/1993 | Maas et al. | 222/383.1 X |
| 5,312,021 | 5/1994 | Nelson | 222/192 X |

*Primary Examiner*—Andres Kashnikow
*Assistant Examiner*—Kenneth Bomberg
*Attorney, Agent, or Firm*—William M. Hobby, III

[57] ABSTRACT

A liquid container paper towel holder apparatus has a liquid container having an enlarged hollow base and an elongated hollow neck extending from the base. The elongated neck has an open end having external threads adjacent to the open end. A roll of paper towels having a hollow center, such as a paper board tube, is positioned over the liquid container neck and supported at one end on the enlarged hollow base. A spray top having a hand pump and a threaded lid is attached to the elongated neck by threading the lid onto the neck threads. The lid has an extension tube extending therethrough the hollow neck into the enlarged base. The spray top holds the paper towels onto the liquid container at the opposite end from the base. A liquid container may be a molded polymer container having a trigger actuated spray pump attached thereto.

13 Claims, 2 Drawing Sheets

LIQUID CONTAINER PAPER TOWEL HOLDER

BACKGROUND OF THE INVENTION

The present invention relates to a liquid container and especially to a combination of liquid container having a spray pump and supporting a roll of paper towels.

In the past, it has been common to provide a wide variety of liquid containers with spray mechanisms. Various types of spray bottles are sold having window washing liquids stored therein as well as various other cleaning liquids which can be conveniently sprayed onto a surface with a hand spray pump which is frequently trigger operated. When washing windows or the like, it is common to carry a roll of paper towels around with a window spray applicator so that the window can be sprayed and the paper towels then used to clean and wipe the window. Spray bottles and paper towels are also commonly used to clean a variety of office equipment and for general household cleaning.

The prior art patents which have had household cleaning kits which incorporated towels, either paper or cloth, with a container having cleaning liquids can be seen in the Cournoyer patent, U.S. Pat. No. 4,516,676, for a household window cleaning kit which has a liquid applicator and a paper towel dispenser and an absorbent scrubbing element in a single self contained unit. The liquid applicator is placed inside the towel holder. In the Miller patent, U.S. Pat. No. 1,255,772, a combination cleaning outfit is provided for washing and cleaning the hands and face which includes a cleaning liquid container having a drying towel rolled therearound. In the Savery patent, U.S. Pat. No. 1,523,297, a container specifically for motorists is provided which has a detergent liquid therein and a towel holder formed therearound. The Findley patent, U.S. Pat. No. 1,582,645, is a combination liquid soap dispenser and towel rack which mounts to a wall and has a faucet-like dispenser for dispensing the liquid and has a towel holder formed therearound for drawing the towels out. The Brainerd et al. patent, U.S. Pat. No. 3,881,628, is an aerosol can holder which is a hand-operated unit which fits around an aerosol can and has a brush formed thereon for use in polishing shoes.

The present invention is directed towards a liquid container paper towel holder which is portable and which can be operated with one hand. The hand can hold the spray pump mechanism attached to a specially formed container for spraying a liquid cleaner or the like to a surface and then simultaneously pulling paper towels, supported on the container, from a roll. It has the advantage of being portable rather than attached to a wall and keeping the paper towels and cleaning fluids together with the spray nozzle. It also allows for an inexpensive molded container with a standard spray pump and existing paper towel roll to be utilized to reduce the cost of the item.

SUMMARY OF THE INVENTION

A liquid container paper towel holder apparatus has a liquid container having an enlarged hollow base and an elongated hollow neck extending from the base. The elongated neck has an open end having external threads adjacent to the open end. A roll of paper towels having a hollow center, such as a paper board tube, is positioned over the liquid container neck and supported at one end on the enlarged hollow base. A spray top having a hand pump and a threaded lid is attached to the elongated neck by threading the lid onto the neck threads. The lid has an extension tube extending therefrom through the hollow neck into the enlarged base. The spray top holds the paper towels onto the liquid container at the opposite end from the base. A liquid container may be a molded polymer container having a trigger actuated spray pump attached thereto.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
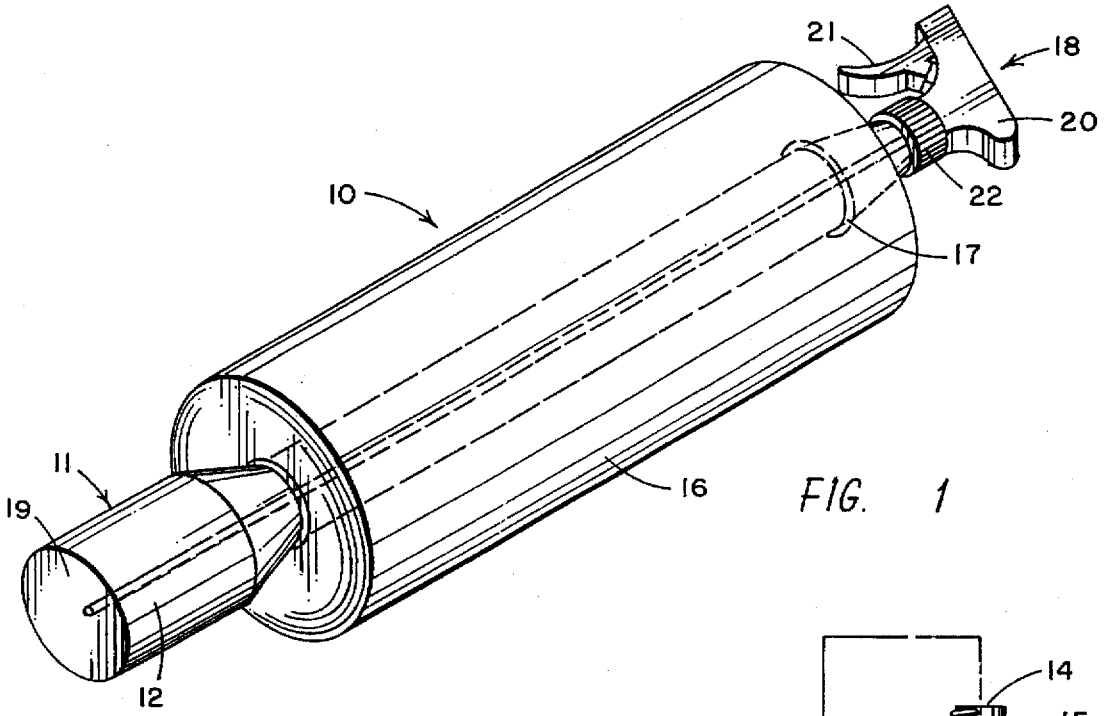
FIG. 1 is a perspective view of a liquid container paper towel holder in accordance with the present invention.
Figure 2:
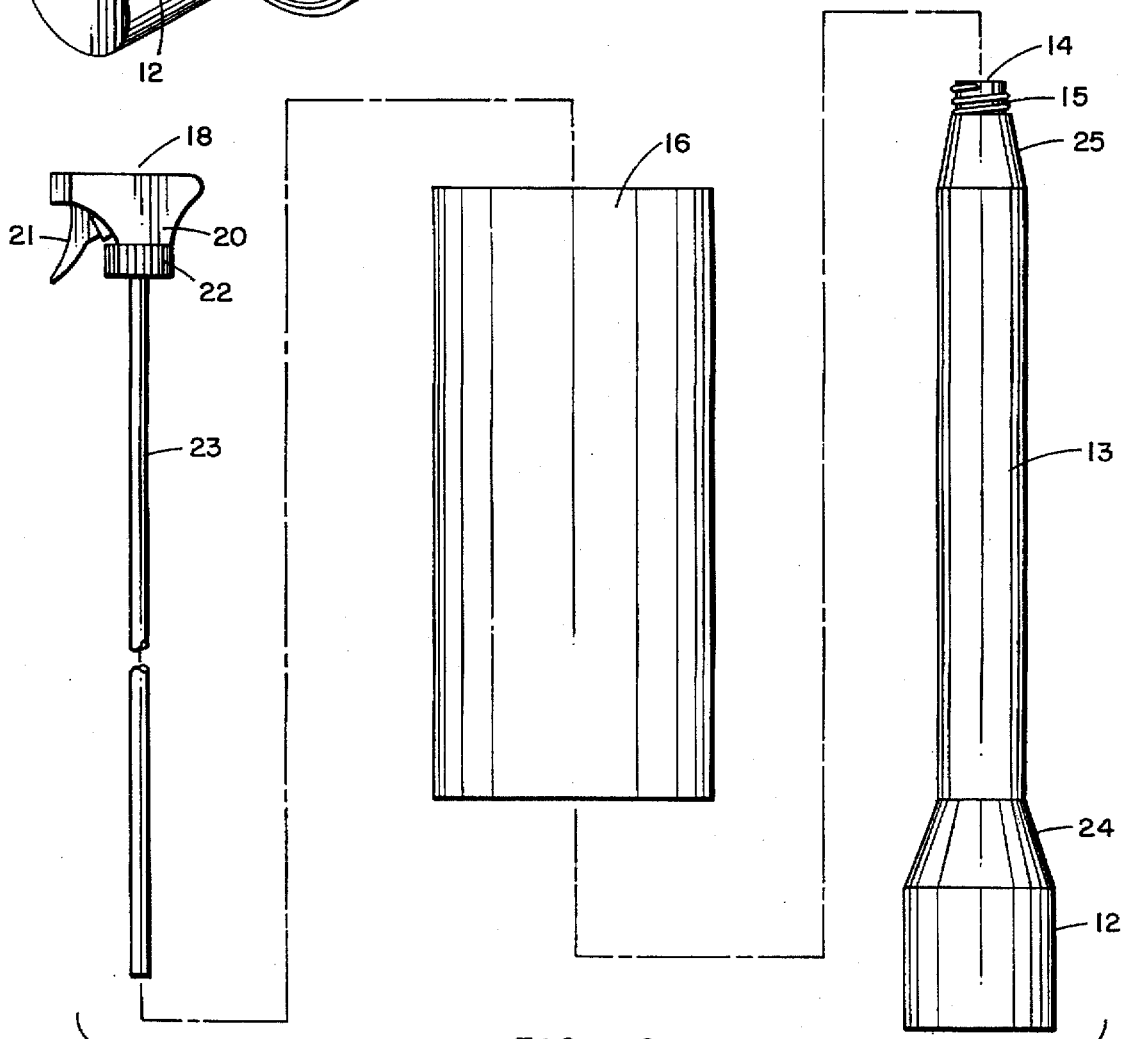
FIG. 2 is an exploded elevation of the liquid container paper towel holder of FIG. 1.

Referring to FIGS. 1 and 2 of the drawings, a liquid container paper towel holder 10 includes a liquid container 11 having an enlarged base 12 and an elongated neck 13. The neck 13 has an open end 14 having external threads 15 adjacent thereto. A paper towel roll 16 may be rolled onto a paperboard tube 17 and fits over the neck 13, as shown in FIG. 1. A spray pump 18 has a spray pump handle 20 having a trigger 21 and a container lid 22 which has internal threads which match the threads 15. An extension tube 23 is attached to the lid and slides in the hollow neck 13 and into the enlarged hollow base 12. Once the paper towel roll 16 is placed on the neck 13 and the spray pump 18 is attached to the container 11, the spray pump head 20 will hold the roll of paper towels 16 onto the neck 13 from one end while the enlarged base 12 will support the paper towel roll from the opposite end. The base 12 has a flat bottom 19 to support the container erect on a flat surface. The angled surface 24 of the enlarged base can, of course, be a flat surface or of any shape desired but the angled surfaces allow for the handling of different size tubes holding the paper towels and allows for easy removal from the mold used in molding a plastic container.

The neck 13 is sized for the standard hollow center or tube of a standard roll of paper towels 16 and is angled at 25 to bring it down to the size for a standard spray pump 18 to be threaded onto the threads 15. The container 11 can be made of a molded polymer material, such as a blow molded plastic, while the spray pump 18 can be a standard commercial spray pump having an elongated tube 23 to reach the extra length for the container 11. As seen in FIGS. 1 and 2, the neck 13 might typically be more than four times the length of the enlarged base 12 so that a fairly large volume of liquid, such as a cleaning fluid, can be held in the container 12. In addition, the length and/or width of the base can be altered so that different volumes of liquid may be contained. If desired, a washer-like sleeve can be supported beneath the lid 22 to block the paper towels from sliding up into the pump handle 20.

In operation, an individual can hold the pump handle 20 of the spray pump 18 in one hand with the container and towels below while spraying onto a surface and then simply pull one or more of the paper towels from the roll of paper towels 16. The liquid container 11 can be refilled with any liquid desired or can be sold prefilled with a cleaning liquid and the paper towels can be an off-the-shelf purchased paper towel merely slid onto the container and replaced when the towels are exhausted.

Figure 3:
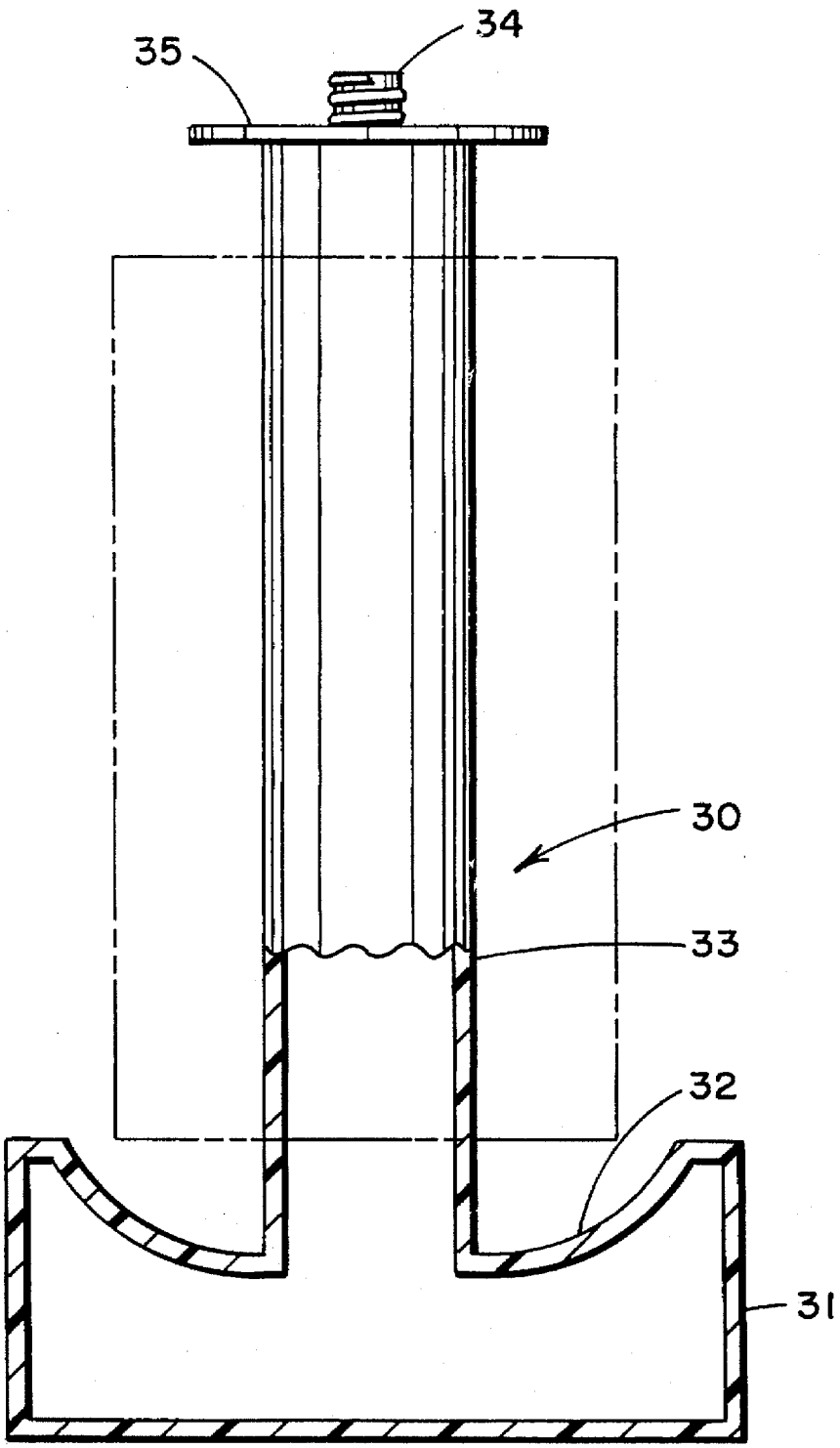
FIG. 3 is a side elevation view of a second embodiment of my towel holder.

FIG. 3 shows an alternate embodiment of a container 30 having a base having an annular concave curvature 32 and an elongated neck 33 extending therefrom. The neck 33 has a cap 34 thereon with a towel roll locking member 35 which is shaped like an enlarged washer and held in place with the screw on cap 34. The member 35 prevents the roll of towels from coming off.

It should be clear at this time that a liquid container paper towel holder and spray pump combination has been provided which are inexpensive to manufacture and use and which advantageously allows for one hand use and easy replacement of paper towels and cleaning liquids. However, the present invention is not to be construed as limited to the forms shown which are to be considered illustrative rather than restrictive.

I claim:

1. A liquid container paper towel holder comprising:

a polymer liquid container having an enlarged hollow base having an angled annular surface extending therefrom and an elongated neck extending from the angled annular surface, said elongated neck having an open end and having external threads adjacent to the open end;

a roll of paper towels having a hollow center positioned over said liquid container neck and supported at one end on said enlarged hollow base; and a spray top having a hand pump and a threaded lid attached to said liquid container thread adjacent said open end thereof and holding said roll of paper towels on said liquid container elongated neck; whereby a spray container can be used to spray a liquid and as a support for a roll of paper towels.

2. A liquid container paper towel holder in accordance with claim 1 in which the spray top has a tube attached thereto and extending the length of the container neck and into said enlarged hollow base.

3. A liquid container paper towel holder in accordance with claim 1 in which said liquid container hollow base angled annular surface is a generally concave surface.

4. A liquid container paper towel holder in accordance with claim 2 in which said liquid container neck threads are external threads formed onto said bottle neck.

5. A liquid container paper towel holder in accordance with claim 4 in which said spray top threaded lid has internal threads thereon for threading onto said liquid container neck threads.

6. A liquid container paper towel holder in accordance with claim 5 in which said liquid container elongated neck is at least three times as long as said enlarged base.

7. A liquid container paper towel holder in accordance with claim 6 in which said paper towels are wrapped on a hollow tube.

8. A liquid container paper towel holder in accordance with claim 7 in which said hollow tube is a paper board tube.

9. A liquid container paper towel holder in accordance with claim 8 in which said lid removably locks said hollow roll of paper towels onto said liquid container neck.

10. A liquid container paper towel holder in accordance with claim 9 in which said spray top has a trigger pull actuated pump to spray liquid.

11. A liquid container paper towel holder in accordance with claim 1 having a towel roll locking member attached between said spray top and said elongated neck to thereby hold said roll of paper towels to said liquid container.

12. A liquid container paper towel holder in accordance with claim 11 in which said towel roll locking member is disk shaped having an aperture therethrough sized to fit over said elongated neck threads adjacent to the open end of said liquid container.

13. A liquid container paper towel holder in accordance with claim 1 in which said liquid container hollow base angled annular surface is a generally truncated cone.

* * * * *